US006641377B2

(12) United States Patent
Toyama et al.

(10) Patent No.: US 6,641,377 B2
(45) Date of Patent: Nov. 4, 2003

(54) LINEAR COMPRESSOR WITH A PLURALITY OF SUPPORT SPRINGS AND A DUAL COMPRESSION UNIT

(75) Inventors: Kentaro Toyama, Tokyo (JP); Yukio Yasukawa, Tokyo (JP); Keishi Ohshima, Tokyo (JP)

(73) Assignee: Fuji Electric Co., Ltd., Kawasaki (JP)

( * ) Notice: Subject to any disclaimer, the term of this patent is extended or adjusted under 35 U.S.C. 154(b) by 0 days.

(21) Appl. No.: 09/985,947

(22) Filed: Nov. 6, 2001

(65) Prior Publication Data

US 2002/0057974 A1 May 16, 2002

(30) Foreign Application Priority Data

Nov. 13, 2000 (JP) ..... 2000-345783
Aug. 24, 2001 (JP) ..... 2001-254116

(51) Int. Cl.[7] ..... F04B 17/03
(52) U.S. Cl. ..... 417/417; 417/416; 417/419; 417/488
(58) Field of Search ..... 417/416, 417, 417/419, 488

(56) References Cited

U.S. PATENT DOCUMENTS 6,129,527 A * 10/2000 Donahoe et al. ..... 417/416
6,231,310 B1 * 5/2001 Tojo et al. ..... 417/44.1
6,283,012 B1 * 9/2001 Kato et al. ..... 92/155
2001/0051099 A1 * 12/2001 Yatsuzuka et al. ..... 417/417

FOREIGN PATENT DOCUMENTS

JP 10037856 A * 2/1998 ..... F04B/27/00
JP 11182424 A * 7/1999 ..... F04B/35/04

* cited by examiner

*Primary Examiner*—Cheryl J. Tyler
*Assistant Examiner*—Emmanuel Sayoc
(74) *Attorney, Agent, or Firm*—Kanesaka & Takeuchi

(57) ABSTRACT

In a compressor, a yoke constituting a linear drive section together with a driver coil, through which magnetic fluxes from a permanent magnet pass, is integrated with a cylinder and a container. A piston inserted into the cylinder is supported by springs, and the other end thereof faces an operating-gas-compressing space. The linear drive section is arranged parallel to the piston in a diametrical direction thereof. This construction reduces the longitudinal dimension of a piston portion. Further, a plurality of parts is combined together in a main body block, thereby reducing the number of parts required and improving the assembly accuracy.

12 Claims, 10 Drawing Sheets

LINEAR COMPRESSOR WITH A PLURALITY OF SUPPORT SPRINGS AND A DUAL COMPRESSION UNIT

BACKGROUND OF THE INVENTION AND RELATED ART STATEMENT

The present invention relates to a compressor for use in a cryogenic refrigerator.

Compressors of this kind are described in Japanese Patent No. 2522424 and Japanese Patent Publications (KOKAI) No. 5-288419 and No. 8-110110. FIG. 9 is a vertical sectional view showing a compressor disclosed in Japanese Patent Publication No. 8-110110, and FIG. 10 is a vertical sectional view showing only a movable portion thereof. In FIGS. 9 and 10, a piston 3 is inserted into a cylinder having a cylindrical space, via a gap 2, to form an operating-gas-compressing space 5 in the cylindrical space of the cylinder 1 enclosed by a cylinder head 4. A piston shaft 6 is coaxially secured to the piston 3. The piston 3 is supported by two support springs 7 and 8 for free reciprocation in the axial direction. The support springs 7 and 8 are composed of plate springs attached to the piston shaft 6 with an axial gap formed therebetween.

The piston 3 is driven by a linear drive section 9 to reciprocate in the axial direction. The linear drive section 9 includes a driver coil 11 wound around a coil bobbin 10 secured to the piston shaft 6, and a magnetic circuit having a void 12 in which the driver coil 11 is accommodated. The magnetic circuit is formed by an annular magnet 13, and a flanged cylindrical yoke 14 and an annular yoke 15 arranged on the respective sides of the magnet 13. The yoke 14 has a cylindrical frame 16 connected thereto, and the frame 16 has a bottomed two-stage cylindrical frame 17 connected thereto. The cylinder head 4, the cylinder 1, the yoke 4, and the frames 16 and 17 constitute one pressure container generally forming a gas chamber 34. The gas chamber 34 leads to the compressing space 5 via the gap 2.

Here, a procedure of assembling a major portion of the compressor in FIG. 9 will be described. The yokes 14 and 15 are stuck to and integrated with the permanent magnet 13 by using an adhesive. The frame 16 is combined with the integrated parts, and the combined parts are tightened together using screws (not shown). Then, the support spring 7 is combined with the yoke 14 from above in FIG. 9 via their fitting portions, and these combined parts are tightened together by using screws (not shown). Then, the piston shaft 6, integrated with the piston 3, is inserted into a central hole in the support spring 7 from above. Furthermore, an interval tube 18, a coil bobbin 10, a washer 19, a sleeve 20, and the support spring 8 are sequentially fitted on the piston shaft 6 from below as shown in FIG. 10. At the same time, the support spring 8 is combined with the frame via their fitting portions, and the combined parts are tightened by using screws (not shown).

Further, on the piston shaft 6, the support spring 7, the interval tube 18, the coil bobbin 10, the washer 19, the sleeve 20, and the support spring 8 are tightened between the piston 3 and a washer 21 by a nut 22. Subsequently, the frame 17 is combined with the frame 16 via their fitting portions and secured thereto by fillet welding. Reference numerals 23*a* and 23*b* denote a movable portion and a fixed portion, respectively, of a displacement sensor for detecting the axial displacement of the piston 3. The movable portion 23*a* is attached to the piston shaft 6 after tightening the nut 22. As described above, a unit formed of the piston 3, the support springs 7 and 8, the yokes 14 and 15, the frames 16 and 17, and others, which are integrally assembled, is inserted into the cylinder 1, which is separately supported on an assembly frame. The piston 3 is carefully aligned, and the yoke 14 is then tightened against the cylinder 1 by using a screw 24.

In such a compressor, magnetic fluxes generated by the permanent magnet 13 return from the N pole surface thereof through the yoke 15, the void 12, and the yoke 14 to the S pole surface thereof. Thus, when a current is periodically conducted through the driver coil 11, a magnetic force is generated between this current and the magnetic fields in the void 12 to reciprocate the piston 3 in the axial direction, thereby compressing an operating gas in the compressing space 5. A pressure wave from the compressed gas is applied to a cryogenic refrigerator (not shown) through a gas channel 25 in the cylinder head 4.

The above conventional compressor has the following problems.

(1) The piston 3 has the piston shaft 6 secured thereto, the piston shaft 6 has the linear drive section 9 arranged radially outside the piston shaft 6, and the support springs 7 and 8 are arranged on the respective sides of the linear drive section 9 in the axial direction. Thus, the piston 3, the linear drive section 9, and the plurality of springs 7 and 8 are linearly arranged in the axial direction, resulting in a long movable portion to increase the longitudinal dimension of the compressor.

(2) Between the support springs 7 and 8, the fitting portions are present between the support spring 7 and the yoke 14, between the yoke 14 and the frame 16, and between the frame 16 and the support spring 8. Accordingly, parts and assembly errors may be accumulated in the fitting portions to cause misalignment between the support springs 7 and 8. This misalignment may incline the axis of the piston 3 to the cylinder 1 to bring the piston and the cylinder into contact with each other, thus causing friction therebetween.

(3) For assembly, the support spring 7 and the piston 3 are inserted from one side (from the upper side in FIG. 9) of the linear drive section 9 in the axial direction, and the interval tube 18, the coil bobbin 10, and the support spring 8, and others are inserted from the other side (from the lower side in FIG. 9). Consequently, one-direction assembly can not be made on the linear drive section 9, preventing an easy assembly operation.

Thus, the object of the present invention is to solve these problems by decreasing the size of compressor, increasing the accuracy thereof, and allowing the compressor to be assembled more easily.

SUMMARY OF THE INVENTION

The present invention provides a compressor comprising a cylinder having a cylindrical space, a piston inserted into the cylinder via a gap forming a clearance seal, the piston forming an operating-gas-compressing space in the cylindrical space, support springs composed of a plate spring for supporting the piston for free reciprocation in the axial direction, a linear drive section for driving the piston to reciprocate in the axial direction, and a pressure container that forms a gas chamber leading to the compressing space via the gap. The linear drive section is formed by a driver coil connected to the piston, and a magnetic circuit composed of a permanent magnet having a void in which the driver coil is located. The spring is arranged at an interval at the end of the corresponding piston which is opposite to the compressing space, and the linear drive section is arranged radially outside the compressing-space-side end of the piston (a first aspect of the invention).

According to the first aspect of the invention, one end of the piston is supported by the plurality of support springs in a cantilever manner, and the linear drive section is arranged radially outside the other end of the piston. Accordingly, the entire length of movable portion can be shorter than that of the piston, so that the longitudinal dimension of the compressor can be decreased. Further, since the plurality of support springs is arranged together at one side of the linear drive section, a surface of the compressor main body on which the support springs are fitted can be shared easily by the support springs. Consequently, the support springs can be more accurately aligned with each other, and the plurality of support springs can be assembled on the linear drive section from one direction.

In this case, the driver coil, permanent magnet, and yoke of the linear drive section are preferably arranged in the radial direction of the piston. This arrangement reduces the axial dimension of the linear drive section (a second aspect of the invention).

The cylinder and the yoke are preferably integrated. This arrangement eliminates an assembly error between the cylinder and the yoke, and reduces the number of parts required (a third aspect of the invention).

Further, the yoke and the main body of the pressure container are integrated, and the main body preferably supports the support springs. This arrangement eliminates an assembly error between the pressure container main body and the yoke, and reduces the number of parts required. Further, one-way assembly is enabled in which the coil bobbin and the support springs are inserted over the piston from the same side of the axial direction, and the piston is also inserted into the cylinder from this side (a fourth aspect of the invention).

On the other hand, the support springs are preferably installed so that a front or rear side of one of the support springs faces a rear or front side of the other, respectively. It is difficult to completely offset different spring characteristics of the front and rear sides of the support spring. However, by arranging the front or rear side of one of the plurality of support springs so as to face the rear or front side of the other, respectively, the above different characteristics can be offset to prevent a tip of the piston from swinging during reciprocation, as well as the rotation of the piston caused by the torsion of the support springs can be prevented (a fifth aspect of the invention).

A proper value for the interval between the support springs is determined by the structural analysis based on the weight of the movable portion (including the piston, the coil bobbin, the driver coil, and others), the rigidity of the support springs, and the gap between the piston and the cylinder. To maintain this proper interval, an interval piece is preferably provided to define the interval between the support springs (a sixth aspect of the invention).

Preferably, a lubricating solid coat, which can be detached whenever necessary, of a thickness corresponding to the gap is applied to one or both of the inner peripheral surface of the cylinder and the outer peripheral surface of the piston, and the inner peripheral surface and the outer peripheral surface are fitted to allow the piston to be inserted into the cylinder (a seventh aspect of the invention). By inserting the piston into the cylinder by the fitting, the piston and the cylinder can be accurately aligned with each other (a seventh aspect of the invention).

The compressor can be constructed such that a pair of the pistons face each other with the compressing space being located therebetween. The compressing space is shared by these pistons. Thus, vibrations caused by the reciprocation of the pistons can be offset, whereby the vibration of the entire compressor can be minimized (an eighth aspect of the invention).

Furthermore, in the above compressor, a driver coil on the piston side is formed with electricity by an external connection terminal fixed to the pressure container, via a lead. Since the piston reciprocates in the axial direction relative to the pressure container, a driver-coil-feeding lead is constructed to move in the axial direction, and one end thereof is held on the piston side, while the other end thereof is held on the pressure container side. In the present invention, this driver-coil-feeding lead is provided between the support springs (a ninth aspect of the invention). This allows the driver-coil-feeding lead to be arranged in a space in which the support springs are accommodated, thus reducing the longitudinal dimension of the compressor compared to the case in which this lead is arranged axially outside the support spring.

In the compressor according to the ninth aspect of the invention, an intermediate terminal joining the driver-coil-feeding lead and the driver coil, and another intermediate terminal joining the driver-coil-feeding lead and an external connection terminal are provided on the piston side and the pressure container side, respectively, by penetrating support springs (a tenth aspect of the invention). This arrangement eliminates the need to pass the wires connecting the driver-coil-feeding lead and the driver coil, and the wires connecting the driver-coil-feeding lead and the external connection terminal through the holes in the support springs, thereby simplifying a wiring operation. Moreover, if the driver-coil-feeding lead and the internal terminals are integrally coupled, no wire is required which connects the driver-coil-feeding lead and each of the intermediate terminals, thereby further simplifying the wiring operation (an eleventh aspect of the invention).

DETAILED DESCRIPTION OF PREFERRED EMBODIMENTS

Figure 1:
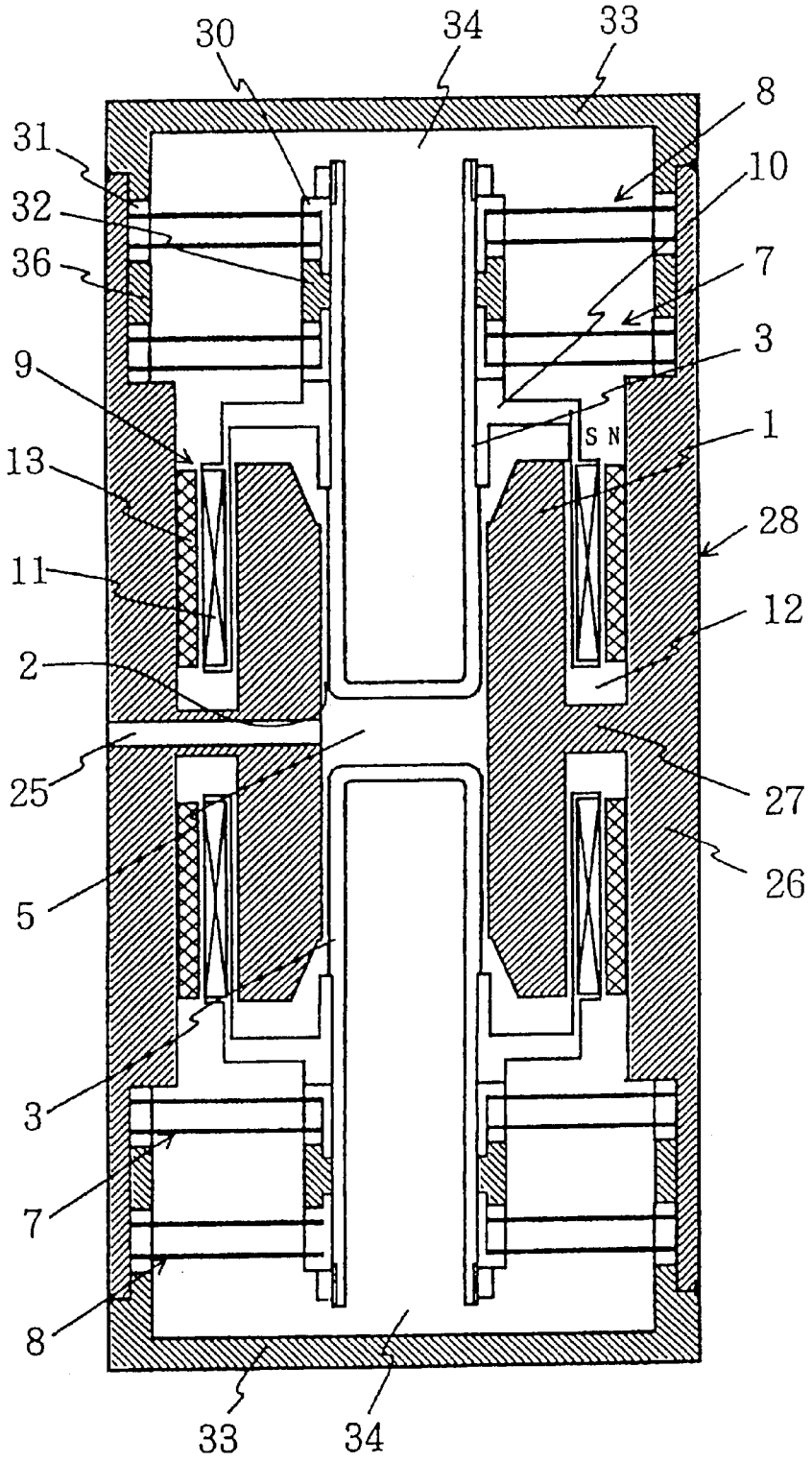
FIG. 1 is a vertical sectional view of a compressor according to one embodiment of the present invention.
Figure 2:
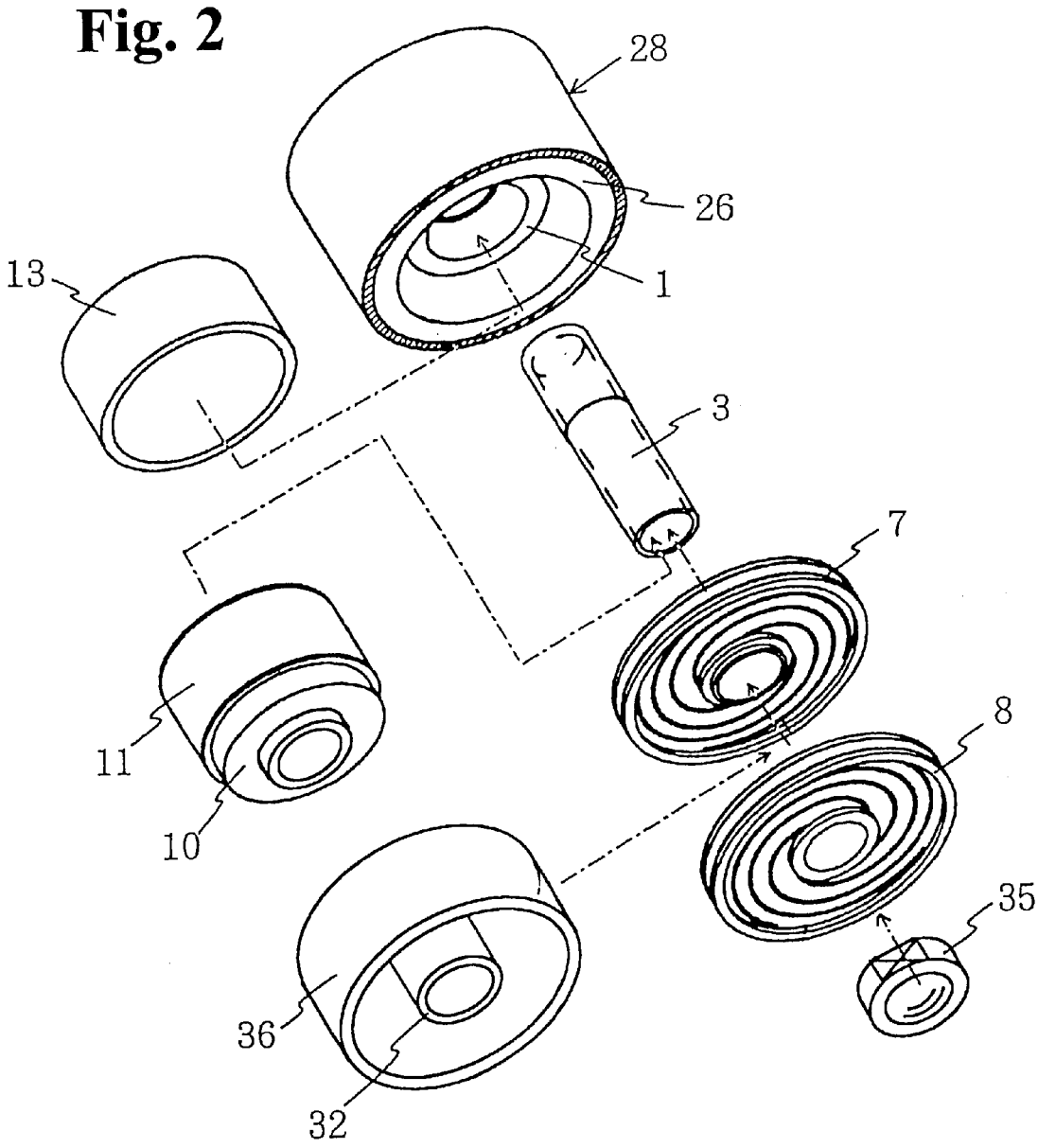
FIG. 2 is an exploded perspective view of a main part of the compressor shown in FIG. 1.
Figure 3:
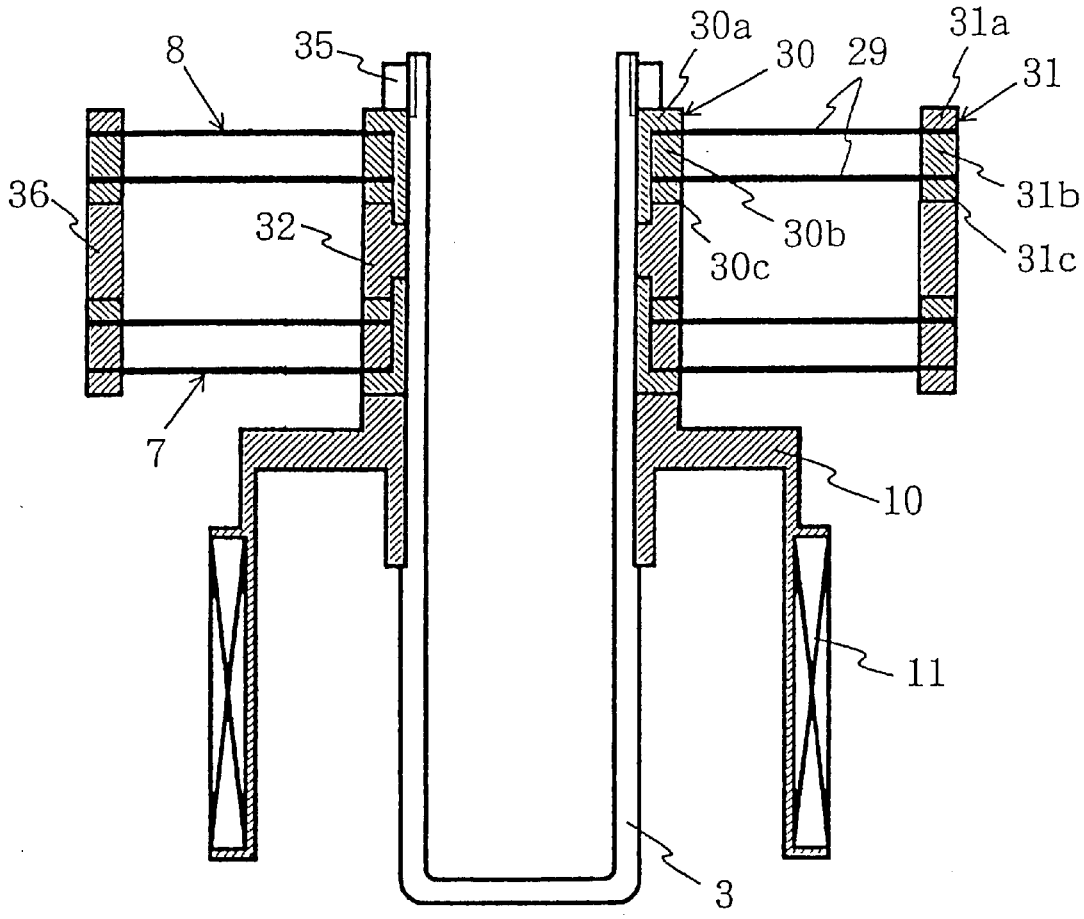
FIG. 3 is a vertical sectional view of a piston shown in FIG. 1.

Embodiments according to first to eighth aspects of the invention will be described below with reference to FIGS. 1 to 3. FIG. 1 is a vertical sectional view of a compressor of the present invention, FIG. 2 is an exploded perspective view of a main part of the compressor shown in FIG. 1, and FIG. 3 is a vertical sectional view of a piston portion of the compressor shown in FIG. 1. The parts corresponding to the conventional example have the same reference numerals. In FIGS. 1 to 3, the illustrated compressor has a main body block 28 as a double cylindrical member composed of a cylindrical cylinder 1, a cylindrical pressure container main body 26 located outside the cylinder 1, and an annular rib 27 coupling the cylinder 1 and the pressure container main body 26. The main body block 28 is integrally constructed by cutting or grinding a magnetic material, such as structure steel, for example. A pair of pistons 3 is inserted into a cylindrical space in the center of the cylinder 1 to have, for example, a 10 to 15 $\mu$m gap 2 with an operating-gas-compressing space 5, and faces each other. Each piston 3 is formed as a hollow member by welding a disk to one end of a non-magnetic material, for example, a stainless pipe.

The pistons are respectively supported by two support springs 7 and 8 in a cantilever manner, on the corresponding end of the pressure container 26 which is opposite to the compressing space 5. The support springs 7 and 8 are known in the art, and each comprises two circular plate springs 29 formed of a beryllium steel plate or the like. The springs are arranged in parallel at an interval. Each of the plate springs 29 has a spiral slit cut therein and composed of a plurality of lines, and, hence, is easily deformed in the axial direction. In FIG. 3, each of the plate springs 29 is gripped by a boss 30 and a rim 31 in the central and peripheral portions thereof, the boss 30 and rim 31 being formed of bronze and being concentric with each other. The boss 30 is formed of a flanged bush 30*a*, and ring plates 30*b* and 30*c*. The two plate springs 29 and the ring plates 30*b* and 30*c* are alternately fitted in the bush 30*a* via a central hole, and are integrally coupled by press fitting pins (not shown) penetrating these components.

Further, the rim 31 is formed of three ring plates 31*a*, 31*b*, and 31*c*. These ring plates and the two plate springs 29 are alternately placed on one another, and all these plates are integrally welded. The inner peripheral surface of the boss 30 and the outer peripheral surface of the rim 31 are precisely coaxially polished. For the support springs 7 and 8, when the boss 30 is tightly fitted on the piston 3, the rim 31 is tightly fitted on the shared fitting surface of the pressure container main body 26. Thus, the support springs 7 and 8 are very accurately aligned with each other. On the other hand, the inner peripheral surface of the pressure container main body 26 and the inner peripheral surface of the cylinder 1 are precisely coaxially polished. Consequently, the piston 3 and the cylinder 1, supported on the pressure container main body 26 via the support springs 7 and 8, are very accurately aligned with each other by the above fitting. Ring-shaped interval pieces 32 and 36 are interposed between the support springs 7 and 8 to define the interval between the support springs 7 and 8.

The pressure container main body 26 has a cylindrical permanent magnet 13 fitted on and secured to the inner peripheral surface thereof using an adhesive, and the permanent magnet 13 is located radially outside the compressing-space-side end of the piston 3 and is magnetized in the radial direction. A driver coil 11 is accommodated in a void 12 between the inner peripheral surface of the permanent magnet 13 and the outer peripheral surface of the cylinder 1 via a gap. The driver coil 11 is wound around a bobbin 10 formed of a resin mold or stainless steel. The bobbin is fitted into and supported by the piston 3. Both ends of the pressure container main body 26 are respectively blocked with shallow-bottomed cylindrical end plates 33 formed of, for example stainless steel, thus constituting a pressure container. A gas chamber 34 is formed behind the cylinder 1. The gas chamber 34, leading to the compressing space 5 via the gap 2, is filled with an operating gas such as helium. The end plates 33 are each fitted on the pressure container main body 26 via a fitting portion thereof so that the end surface thereof presses the rim 31 of the support spring 8. The end plates 33 are secured to the pressure container main body by welding.

A procedure of assembling the above described compressor will be described below. First, the piston portion shown in FIG. 3 is assembled as a unit. That is, the coil bobbin 10, around which the driver coil 11 is wound, is inserted over the piston 3 until the bobbin 10 abuts against a step on the outer peripheral surface of the piston 3. Then, the support spring 7, the interval piece 32, and the support spring 8 are sequentially inserted, and a hexagonal nut 35 is screwed into a thread groove in the terminal of the piston and then tightened. At this time, the support springs 7 and 8 are installed so that the front or rear surface of the support spring 7 faces the rear or front surface of the support spring 8, respectively. By this arrangement, different characteristics of the front and rear surfaces of the support springs 7 and 8 can be offset, thereby improving the linearity of the reciprocation of the piston 3, while restraining the tip of the piston 3 from swinging. As a result, the piston is prevented from being worn due to contact with the inner peripheral surface of the cylinder. Further, the piston 3 is prevented from being rotated due to the torsion of the support springs 7 and 8. The piston portion is inserted into the main body block 28, to which the permanent magnet 13 has already been secured. Finally, the end plate 33 is fitted on the piston portion and welded and secured thereto.

The piston 3 can be further accurately aligned if before the insertion of the above piston portion into the main body block 28, a solid lubricant such as PTFE which has a film thickness corresponding to the gap 2 or a ceramic coat such as DLC is applied to the surface of the piston or the cylinder 1, so that the piston 3 can be inserted into the cylinder 1 by fitting the cylinder 1 and the piston 3 together. This coat is worn in an initial operation period of the compressor to precisely provide the required gap 2.

The operation of this compressor is essentially the same as that of the conventional one. That is, magnetic fluxes from the N pole of each of the permanent magnets 13, located in the upper and lower parts of FIG. 1, pass through the pressure container main body 26, the rib 27, and the cylinder 1, and then return to the S pole of the magnet via the void 12. Thus, when alternating exciting currents having a phase difference of 180 degrees are conducted through the respective driver coils 11, a magnetic force is generated in the void 12 between the magnetic field and the exciting current to reciprocate the pistons 3 in the axially opposite directions, thereby compressing the operating gas in the compressing space 5. A wave from the compressed gas is applied to an external cryogenic refrigerator or the like via a gas channel 25 formed in the main body block 28 in the radial direction.

Figure 9:
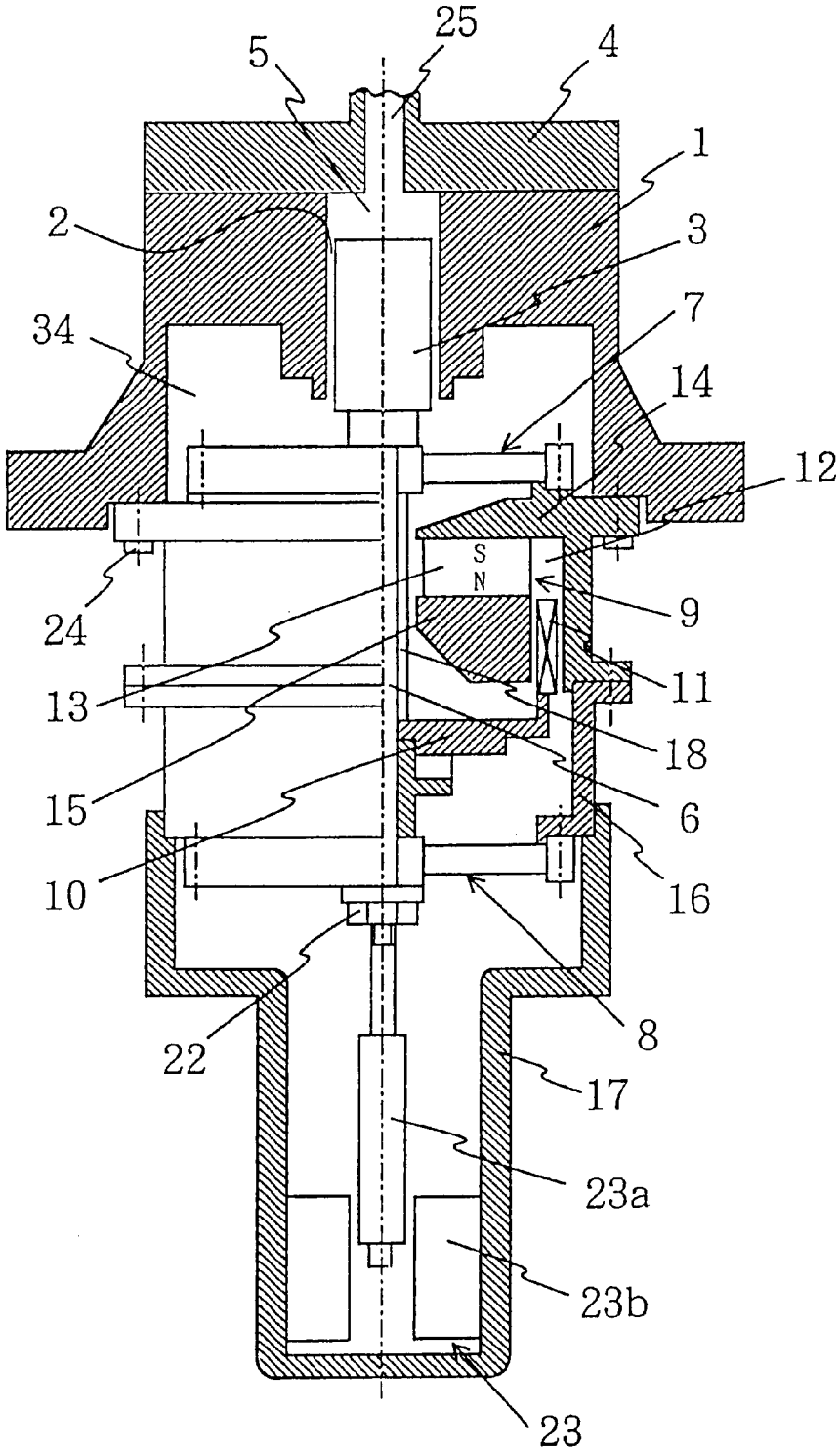
Fig. 9 Prior Art
FIG. 9 is a vertical sectional view of a conventional compressor.
Figure 10:
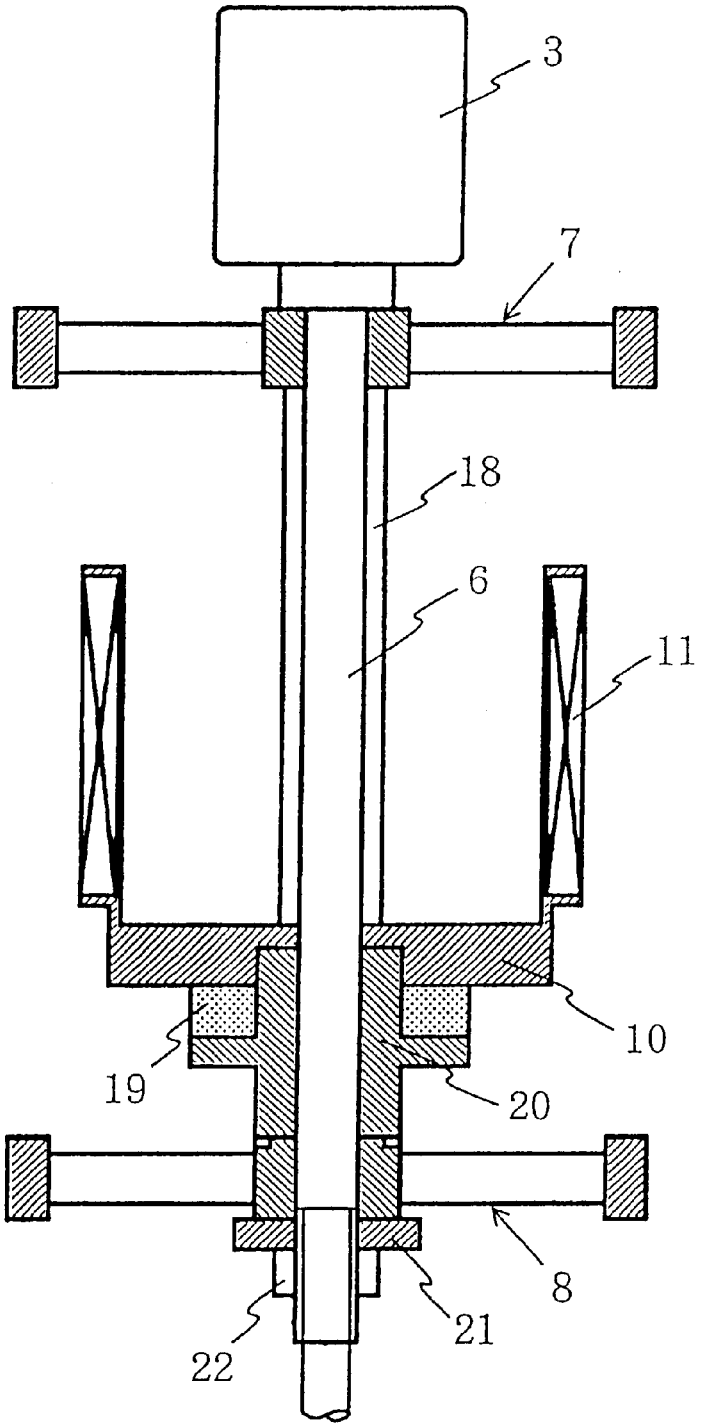
Fig. 10 Prior Art
FIG. 10 is a vertical sectional view of a piston portion of the conventional compressor shown in FIG. 9.

In the compressor in FIG. 1, the piston 3 is supported by the plurality of support springs 7 and 8 in a cantilever manner. The support springs 7 and 8 are arranged, at an interval, at the end of the piston 3 which is opposite to the compressing space-side. Arranged radially outside the compressing space-side end of the piston 3 are the linear drive section 9, which includes the permanent magnet 13 and the driver coil 11, and the pressure container main body 26, the rib 27, and the cylinder 1, which are provided to allow the yoke to function well. Thus, one end of the piston 3 is supported by the plurality of support springs 7 and 8 in a cantilever manner, and the linear drive section 9 is arranged radially outside the other end thereof. Consequently, the support springs 7 and 8 and the linear drive section 9 are arranged in parallel with the piston 3, and the length of the entire movable portion is substantially shorter than the piston 3 as shown in FIG. 9. As a result, the movable portion is shorter than that of the conventional construction, in which the piston 3, the support springs 7 and 8, and the linear drive section 9 are arranged in series in the axial direction. By this arrangement, the longitudinal dimension of the compressor can be reduced. In particular, in the compressor shown in FIG. 1, the driver coil 11, the permanent magnet 13 and the main body and rib 26, 27 of the linear drive section 9 are arranged such that they overlap one on another in the radial direction of the piston 3, thus reducing the axial dimension of the linear drive section, and eventually leading to the significant reduction of the longitudinal dimension of the compressor, as compared to the conventional construction in FIG. 9, in which the permanent magnet 13 and the yokes 14 and 15 are arranged in the axial direction of the piston 3. Furthermore, in the illustrated embodiment, the two support springs are shown, but three or more support springs can be used to support the piston 3 in a cantilever manner.

Then, in FIG. 1, the cylinder 1 is formed of a magnetic material to function as the yoke. In the conventional construction shown in FIG. 9, the yoke 14 is formed separately from the cylinder 1, and the yoke and the cylinder are tightened by means of the screw 24, so that the misalignment is likely to occur. In contrast, in the construction shown in FIG. 1, the misalignment between the yoke 14 and the cylinder 1 or between the cylinder 1 and the piston 3, supported on the support spring 7 via the yoke 14, can be eliminated. The number of parts required can be also reduced.

Further, in FIG. 1, the pressure container main body 26, formed of a magnetic material, functions as the yoke, and the support springs 7 and 8 are fitted on the same fitting surface of the pressure container main body 26. This arrangement prevents the misalignment which is likely to occur in the conventional construction in FIG. 9, in which the frame 16 is tightened against the separate yoke 14 using the screw. In the construction shown in FIG. 1, the misalignment between the yoke 14 and the cylinder 1 or between the support spring 7 supported on the yoke 14 and the support spring 8 supported on the frame 16 does not occur, thus hindering the piston 3 from inclining toward the cylinder 1. Furthermore, the number of parts required is reduced.

In particular, in the illustrated embodiment, the cylinder 1 and the pressure container main body 26 are integrally constructed via the rib 27 to function as the yoke for the magnetic circuit. This arrangement allows the cylinder 1 and the pressure container main body 26 to be integrated into one unit, and enables the cylindrical space of the cylinder 1 and the surfaces (inner peripheral end surfaces of the pressure container main body 26) for supporting the support springs 7 and 8 to be coaxially processed (polished), resulting in a very high axial accuracy therebetween. On the other hand, as already described, the inner and outer peripheral surfaces of the boss 30 and the rim 31 for the support springs 7 and 8 are also precisely coaxially polished, resulting in a high axial accuracy between the piston fitted on the boss 30 and the support springs 7 and 8. As a result, the misalignment between the cylinder 1 and the piston 3 can be minimized.

On the other hand, in the operation of assembling the illustrated compressor, when the piston portion shown in FIG. 3 is assembled, the coil bobbin 10, the support spring 7, the interval piece 32, and the support spring 8 are first inserted into the piston 3 from one side (from the upper side in FIG. 3). Then, after the nut 35 has been tightened, the piston portion is inserted into the main body block 28, and the end plate 33 is then installed and welded. This assembly operation comprises always assembling the parts in one direction and is thus easy, and only a small number of screw tightening operations is required, thus reducing the number of assembly steps required. In this case, the interval piece 32 defines the interval between the support springs 7 and 8. In order to maintain the swing of the tip of the piston 3 supported in a cantilever manner at an allowable value or less to prevent the piston from being worn due to contact with the cylinder 1, the interval between the support springs 7 and 8 must be properly determined by a structural analysis or the like based on the weight of the movable portion including the piston 3 and the rigidity of the support springs 7 and 8. The interval piece 32 serves to maintain this determined interval.

In the illustrated embodiment, the double-acting compressor is shown, in which the pair of pistons 3 faces each other with the compressing space 5 being located therebetween. The compressing space 5 is shared by these pistons. Such a compressor has an advantage that the vibration of the entire compressor can be minimized because vibrations caused by the reciprocation of the pistons 3 can be offset. However, the compressor according to the present invention need not necessarily be the double-acting type. For example, in FIG. 1, the main body block 28 may be divided into upper and lower halves, and then a cylinder head, such as the one in the conventional construction shown in FIG. 9, may be installed on the end surface of one of the halves, thereby obtaining a single-acting compressor with a single piston 3.

Figure 4:
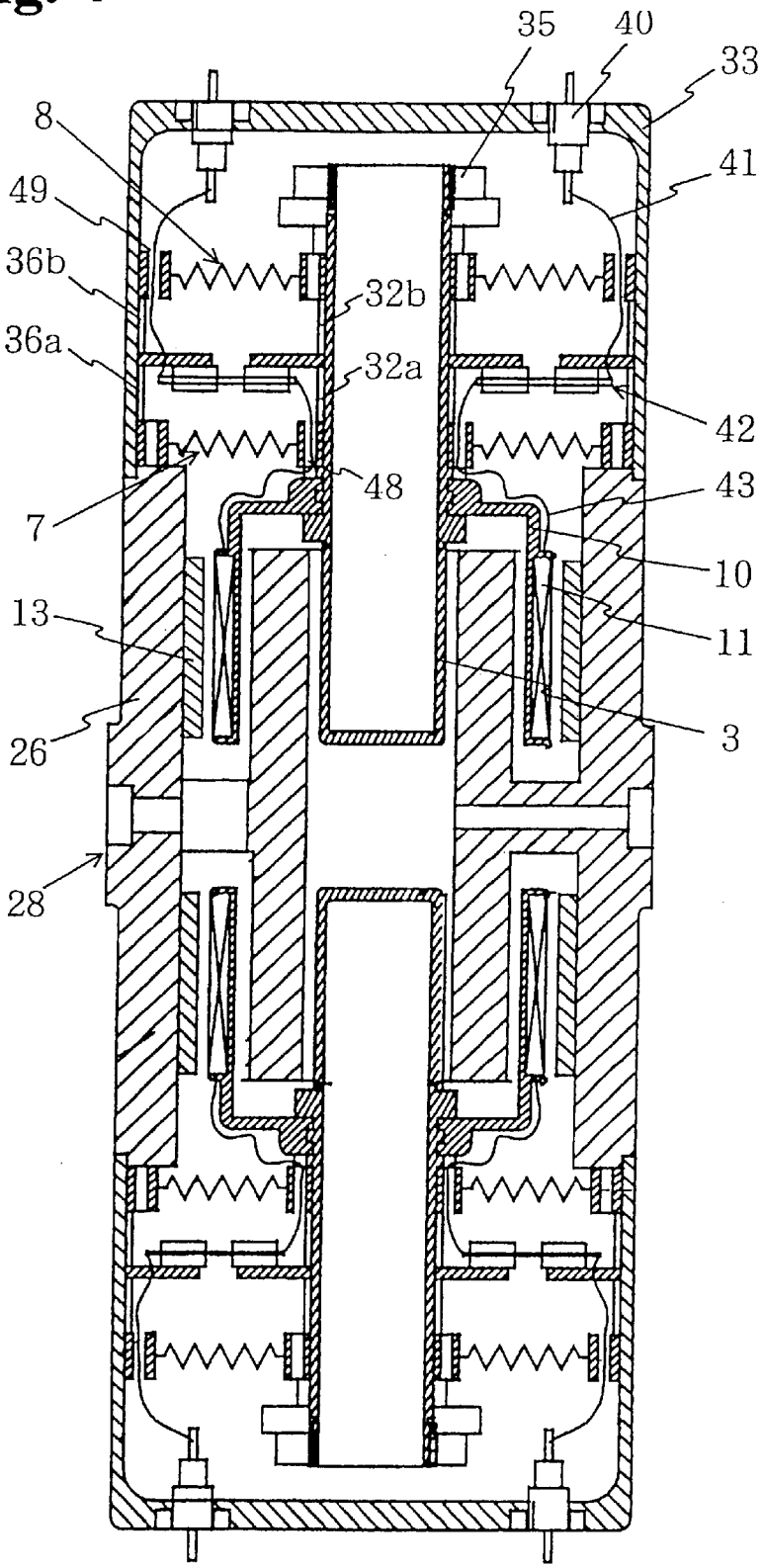
FIG. 4 is a vertical sectional view of a compressor according to another embodiment of the present invention.
Figure 5:
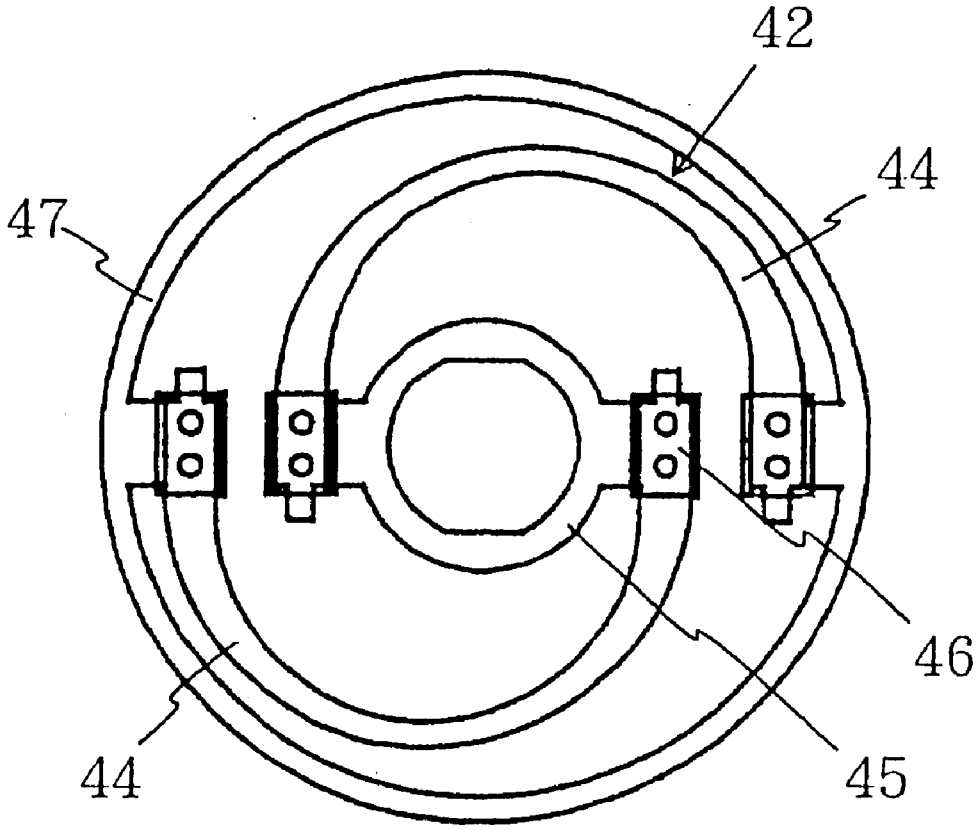
FIG. 5 is a front view of a driver-coil-feeding lead shown in FIG. 4.

FIGS. 4 and 5 show an embodiment according to a ninth aspect of the invention. FIG. 4 is a vertical sectional view of the compressor. FIG. 5 is a front view of the driver-coil lead in FIG. 4. The construction of the compressor shown in FIG. 4 is substantially the same as that shown in FIG. 1, and hence, general description is omitted here. In FIG. 4, the driver coil 11 is fed with electricity through a wire 41, a driver-coil-feeding lead (hereinafter simply referred to as a "lead") 42, and a wire 43, by an external connection terminal 40 fixed to the pressure container side (end plate 33). Here, the lead 42 is formed of a pair of U-shaped conductors 44 combined such that they face each other as shown in FIG. 5. The conductors 44 are made by punching a conductive thin plate, for example, a thin plate of beryllium copper using a press.

Each of the conductors 44 has one end connected to a piston-side holding plate 45 via an insulator 46 using screws, and has the other end connected to a pressure container-side holding plate 47 also via an insulator 46 using screws. Each of the holding plates 45 and 47 is formed of a steel plate. The holding plate 45 has a pair of connection pieces integrally formed to project outward from an annulus that is fitted on the outer peripheral surface of the piston 3, and one end of each conductor 44 is connected to the corresponding connection piece of the holding plate 45. Additionally, the holding plate 47 has a pair of connection pieces integrally formed to project inward from the annulus that is fitted on the inner peripheral surface of the end plate 33, and the other end of each conductor 44 is connected to the corresponding connection piece of the holding plate 47. During the assembly of the piston portion, following the coil bobbin 10, the support spring 7, and one of the pairs of interval pieces 32*a* and 36*a*, the conductors 44 and the holding plates 45 and 47, integrally connected as shown in FIG. 5, are inserted over the piston 3. At this time, the wire 43, one end of which has been connected to the driver coil 11, has the other end connected to one end of the lead 42 through the hole 48 in the boss for the support spring 7. Then, the other pair of interval pieces 32*b* and 36*b*, the support spring 8, and others are inserted, and the nut 35 is finally tightened. At this time, the wire 41, one end of which has been connected to the conductor 44, has the other end withdrawn through the hole 49 in the rim for the support spring 8. After the piston portion has been inserted into the main body block 28, the other end of the wire 41 is connected to the external connection terminal 40 when the end plate 33 is installed.

In FIG. 4, since the lead 42 is arranged between the support springs 7 and 8, a space in which the support springs 7 and 8 are arranged is also used as the space in which the lead 42 is accommodated. Consequently, if the lead 42 is arranged outside the support spring 8, no space is required for the lead 42, so that the longitudinal dimension of the compressor can be reduced.

Figure 6:
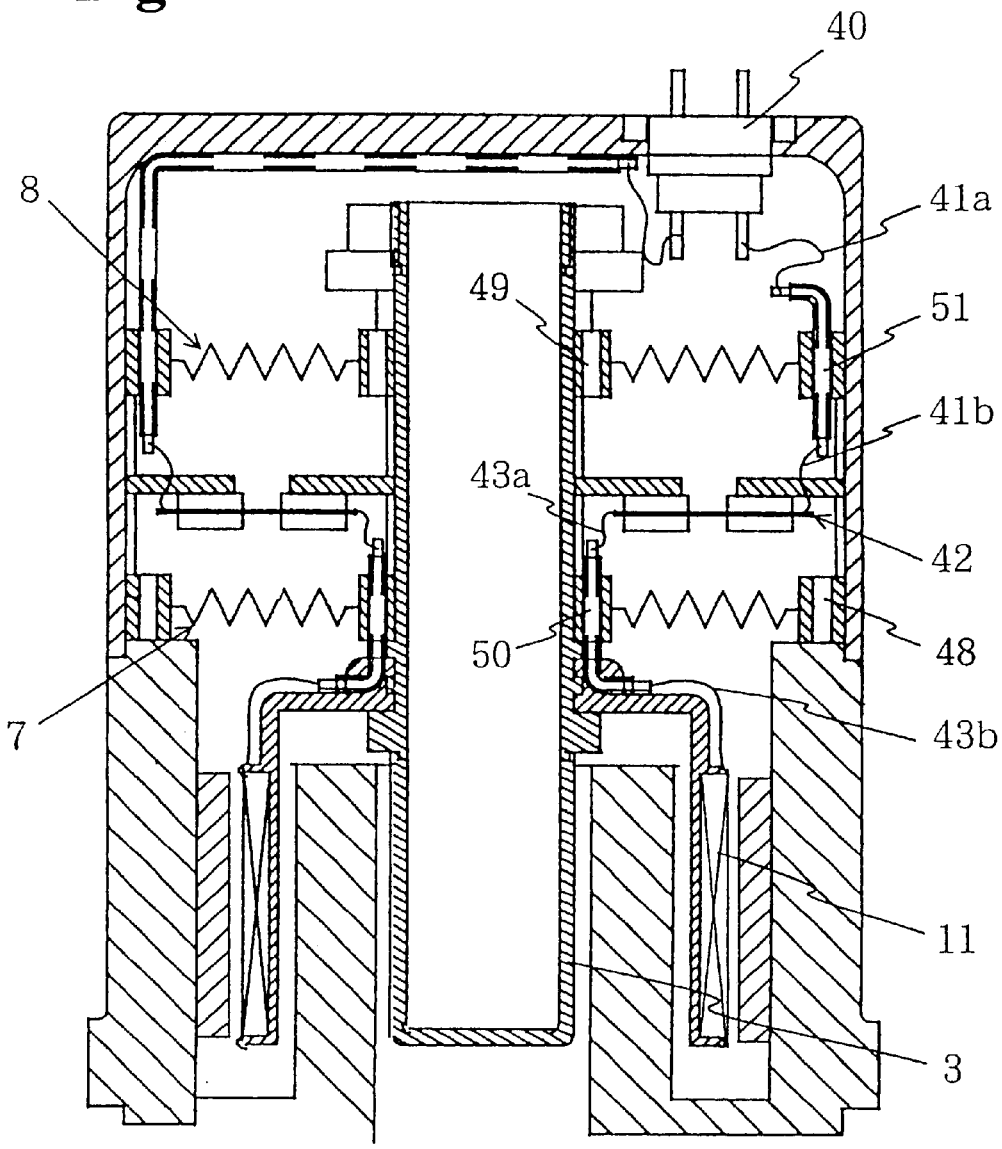
FIG. 6 is a vertical sectional view of a main part of a compressor according to still another embodiment of the present invention.

FIG. 6 is a vertical sectional view of a main part of the compressor, showing an embodiment according to a tenth aspect of the invention. The embodiment shown in FIG. 6 is different from that shown in FIG. 4 in that intermediate terminals 50 and 51 are provided on the piston side and the pressure container side, respectively. Each of the intermediate terminals 50 and 51 is formed of an insulating-coated copper bar, and has an L-shape. As shown in FIG. 6, the intermediate terminals 50 and 51 are pressed into the holes 48 and 49 in the support springs 7 and 8, respectively, through which the wires 43 and 41 shown in FIG. 4 pass, and the opposite ends of the intermediate terminals 50 and 51 project forward and backward from the support springs 7 and 8, respectively. The intermediate terminals 50 and 51 join the lead 42 and the driver coil 11, and the lead 42 and the external connection terminal 40, respectively. Wires 43*a* and 43*b* are used to join one end of the intermediate terminal 50 and the drive coil 11, and the other end of the intermediate terminal 50 and the lead 42, respectively. Wires 41*a* and 41*b* are used to join one end of the intermediate terminal 51 and the external connection terminal 40, and the other end of the intermediate terminal 51 and the lead 42, respectively. According to this embodiment, it is unnecessary to pass the wires 43 and 41 through the holes 48 and 49 in the support springs 7 and 8, thereby simplifying the wiring operation. Furthermore, in FIG. 6, the single external connection terminal 40, which has a dipole structure, is provided. Instead, a pair of such terminals of a single-pole structure as shown in FIG. 4 may be provided.

Figure 7:
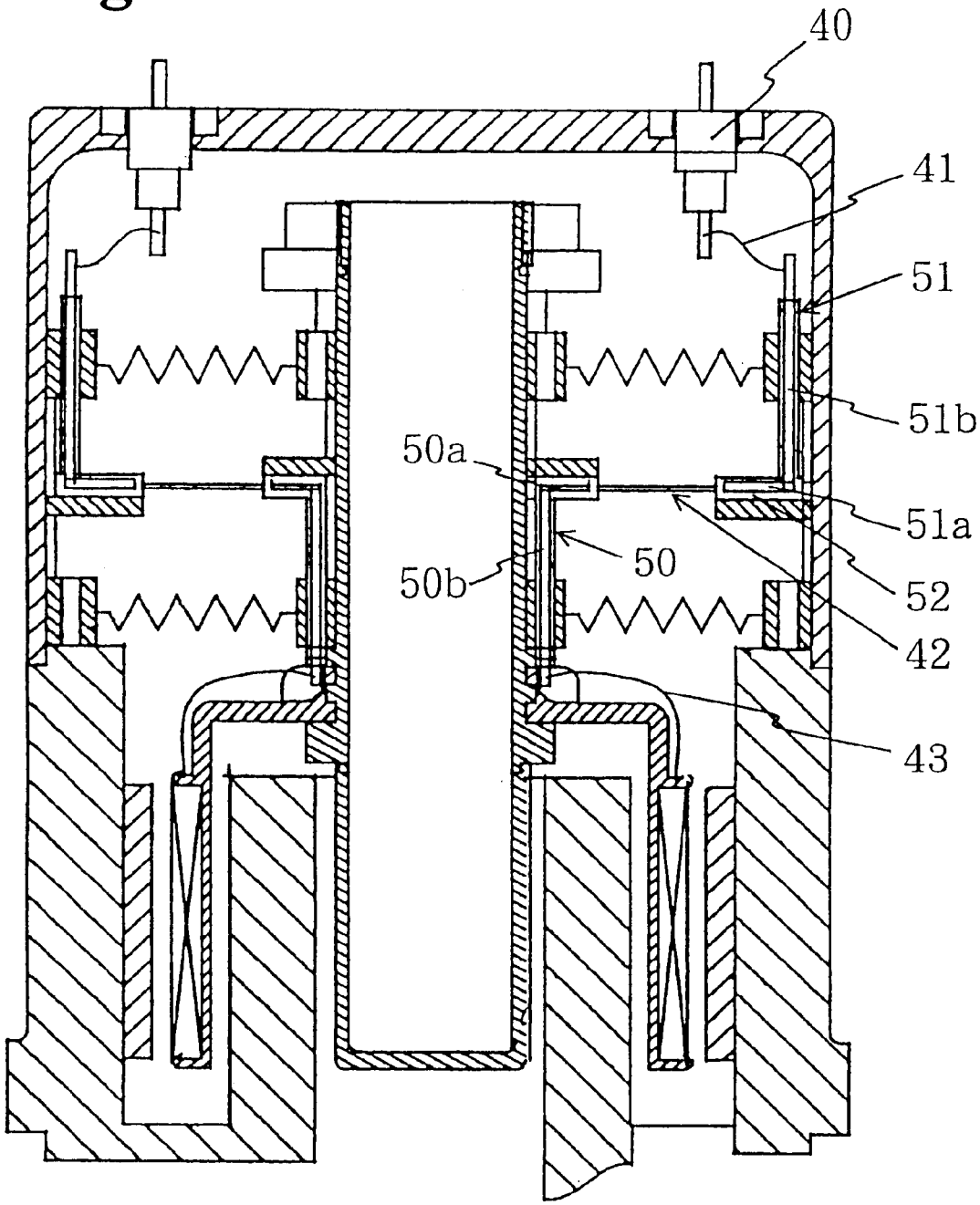
FIG. 7 is a vertical sectional view of a main part of a compressor according to a further embodiment of the present invention.
Figure 8:
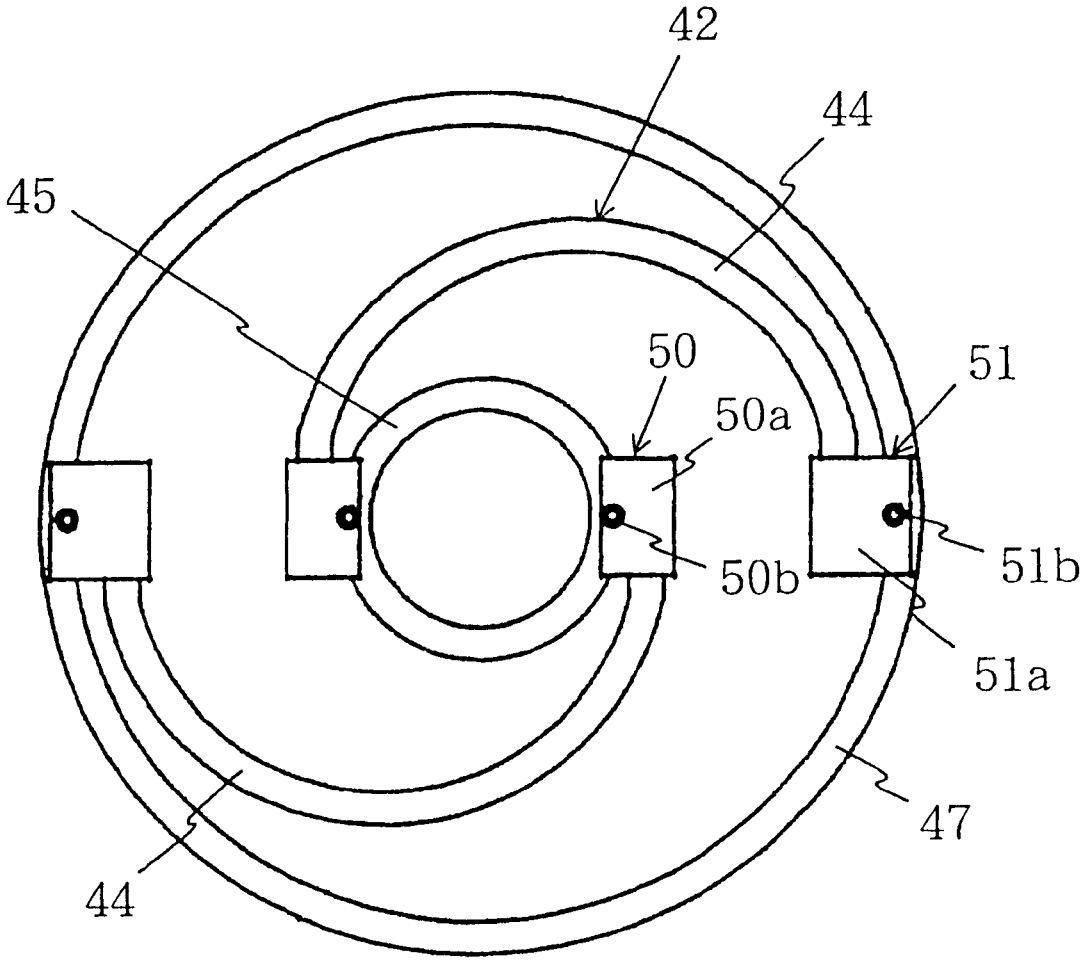
FIG. 8 is a front view of a driver-coil-feeding lead shown in FIG. 7.

FIGS. 7 and 8 show an embodiment according to an eleventh aspect of the invention. FIG. 7 is a sectional view of a main part of the compressor, and FIG. 8 is a front view of the lead 42. The embodiment shown in FIGS. 7 and 8 is different from that shown in FIG. 6 in that the intermediate terminals 50 and 51 and the lead 42 are integrated. In this case, the intermediate terminals 50 and 51 are formed of plate terminals 50*a* and 51*a*, respectively, in a square plate, and rod terminals 50*b* and 51*b*, respectively, coupled orthogonal to the intermediate terminals 50 and 51 by press fitting. The opposite ends of the lead 42 are coupled to the plate terminals 50*a* and 51*a* by spot welding, and an insulating coating 52 is then applied to the entire intermediate terminals 50 and 51 by insert-molding of a resin. The plate terminals 50*a* and 51*a* of the intermediate terminals 50 and 51 are fixed to the holding plates 45 and 47 by using screws (not shown). The rod terminals 50*b* and 51*b* are pressed into the holes 48 and 49 in the support springs 7 and 8. According to this embodiment, the wires 41 and 43 are only used to connect the intermediate terminal 51 and the external connection terminal 40 together, and the intermediate terminal 50 and the driver coil 11 together, respectively, thereby further simplifying the wiring operation.

As described above, according to the present invention, the piston is supported at one end thereof by the plurality of support springs in a cantilever manner, and the linear drive section is arranged radially outside the other end of the piston. Accordingly, the longitudinal dimension of the movable portion can be reduced, so that the size of the compressor can be decreased. Further, as the yoke of the magnetic circuit is integrated with the cylinder and the pressure container main body, the number of the necessary parts can be reduced, and the possibility of using wrong parts or misassembling can be minimized. Consequently, the axial accuracy between the piston and the cylinder is improved to maintain a proper clearance seal. Furthermore, as the parts can be inserted in the single direction, the assembly operation is improved. In combination with a reduced number of parts, such insertion of parts leads to the reduction of the number of assembly steps. In addition, as the driver-coil-feeding lead is arranged between the support springs, both support spring and the driver-coil-feeding lead can be arranged in the same space, eventually resulting in the significant reduction of the longitudinal dimension of the compressor.

While the invention has been explained with reference to the specific embodiments of the invention, the explanation is illustrative and the invention is limited only by the appended claims.

What is claimed is:

1. A compressor, comprising:

a cylinder having a cylindrical space, a piston having front and rear sides, and slidably inserted into the cylinder at the front side to have a gap forming a clearance seal, said front side of the piston forming an operating-gas-compressing space in the cylindrical space, a plurality of support springs attached to the rear side of the piston and arranged at an interval therebetween, each support spring being composed of plate springs spaced apart from each other, said support springs supporting in a cantilever manner the rear side of the piston for free reciprocation in an axial direction of the piston, a linear drive section for driving said piston to reciprocate in the axial direction and located radially outside the cylinder close to the compressing space, said linear drive section including a driver coil connected to the piston, and a magnetic circuit having a yoke and a permanent magnet with a void in which the driver coil is accommodated and a pressure container for forming a gas chamber leading to said compressing space via the gap, a second cylinder, a second piston inserted into the second cylinder at a front side thereof to form a second operating-gas-compressing space in the second cylinder, a plurality of second suppport springs for supporting a rear side of the second piston for free reciprocating in an axial direction thereof, a second linear drive section for driving the second piston to reciprocate in the axial direction and located radially outside the front side of the second piston close to the compressing space, and a second pressure container for forming a second gas chamber, said pistons being arranged to face each other so that the compressing spaces are shared by the pistons and are located therebetween.

2. A compressor according to claim 1, wherein the driver coil, permanent magnet and yoke of the linear drive section are arranged in a radial direction of the piston.

3. A compressor according to claim 2, wherein said cylinder and said yoke are integrally formed together.

4. A compressor according to claim 3, wherein said pressure container includes a main body integrally formed with the yoke, said main body supporting said support springs.

5. A compressor according to claim 1, wherein said plate springs are arranged so that a front or rear side of one of the plate springs faces the rear or front side of the other, respectively.

6. A compressor according to claim 1, further comprising interval pieces provided to define the interval between said support springs.

7. A compressor according to claim 1, further comprising a lubricating solid coat having a thickness corresponding to said gap, said lubricating solid coat being applied to at least one of an inner peripheral surface of the cylinder and an outer peripheral surface of the piston, said inner peripheral surface and said outer peripheral surface being fitted together to allow said piston to be inserted into the cylinder.

8. A compressor according to claim 1, further comprising a driver-coil-feeding lead situated between two of the support springs and having one end held on the piston rod and the other end held on the pressure container.

9. A compressor according to claim 8, further comprising a first intermediate terminal joining said driver-coil-feeding lead and said driver coil, and a second intermediate terminal joining said driver-coil-feeding lead and an external connection terminal provided on the piston rod and the pressure container, respectively, said first and second intermediate terminals penetrating said support springs.

10. A compressor according to claim 9, wherein said driver-coil-feeding lead and said first and second intermediate terminals are integrally coupled.

11. A compressor, comprising a cylinder having a cylindrical space, a piston having front and rear sides, and slidably inserted into the cylinder at the front side to have a gap forming a clearance seal, said front side of the piston forming an operating-gas-compressing space in the cylindrical space, a plurality of support springs attached to the rear side of the piston and arranged at an interval therebetween, each support spring being composed of plate springs spaced apart from each other, said support springs supporting in a cantilever manner the rear side of the piston for free reciprocation in an axial direction of the piston, a linear drive section for driving said piston to reciprocate in the axial direction and located radially outside the cylinder close to the compressing space, said linear drive section including a driver coil connected to the piston, and a magnetic circuit having a yoke and a permanent magnet with a void in which the driver coil is accommodated, a pressure container for forming a gas chamber leading to said compressing space via the gap, a driver-coil-feeding lead situated between two of the support springs and having one end held on the piston rod, the other end held on the pressure container, a container-side holding plate attached to the container, a piston-side holding plate attached to the piston, and two conductors in a U-shape disposed between the container-side and piston-side holding plates, and a first intermediate terminal joining said driver-coil-feeding lead and said driver coil, and a second intermediate terminal joining said driver-coil-feeding lead and an external connection terminal provided on the piston rod and the pressure container, respectively, said first and second intermediate terminals penetrating said support springs.

12. A compressor, comprising:

a cylinder having a cylindrical space, a piston having front and rear sides, and slidably inserted into the cylinder at the front side to have a gap forming a clearance seal, said front side of the piston forming an operating-gas-compressing space in the cylindrical space, a plurality of support springs attached to the rear side of the piston and arranged at an interval therebetween, each support spring being composed of plate springs spaced apart from each other, said support springs supporting in a cantilever manner the rear side of the piston for free reciprocation in an axial direction of the piston, a linear drive section for driving said piston to reciprocate in the axial direction and located radially outside the cylinder close to the compressing space, said linear drive section including a driver coil connected to the piston, a magnetic circuit having a permanent magnet with a void in which the driver coil is accommodated and a yoke, and a bobbin having an inner portion fixed to a center area of the piston and an outer portion for holding the driver coil, a pressure container for forming a gas chamber leading to said compressing space via the gap, a boss having ring plates disposed on the piston adjacent to the inner portion of the bobbin for holding the support springs on the piston, and a rim having ring plates disposed inside the container for holding the support springs on the container.

* * * * *